US010784562B2

(12) United States Patent
Kim et al.

(10) Patent No.: US 10,784,562 B2
(45) Date of Patent: Sep. 22, 2020

(54) WIRELESS COMMUNICATION CHIP HAVING INTERNAL ANTENNA, INTERNAL ANTENNA FOR WIRELESS COMMUNICATION CHIP, AND METHOD OF FABRICATING WIRELESS COMMUNICATION CHIP HAVING INTERNAL ANTENNA

(71) Applicant: LS MTRON LTD., Anyang-si, Gyeonggi-do (KR)

(72) Inventors: Tae Hyung Kim, Anyang-si (KR); Seung Hun Lee, Anyang-si (KR); Hangnga Nguyen, Anyang-si (KR); Seong Soo Han, Anyang-si (KR); Young Ho Kim, Anyang-si (KR)

(73) Assignee: LS MTRON LTD., Anyang-si, Gyeonggi-Do (KR)

( * ) Notice: Subject to any disclaimer, the term of this patent is extended or adjusted under 35 U.S.C. 154(b) by 80 days.

(21) Appl. No.: 16/035,092

(22) Filed: Jul. 13, 2018

(65) Prior Publication Data

US 2019/0020096 A1 Jan. 17, 2019

(30) Foreign Application Priority Data

Jul. 17, 2017 (KR) ..... 10-2017-0090274

(51) Int. Cl.
*H01Q 1/48* (2006.01)
*H01Q 1/22* (2006.01)
(Continued)

(52) U.S. Cl.
CPC ..... *H01Q 1/2266* (2013.01); *H01Q 1/2283* (2013.01); *H01Q 1/38* (2013.01);
(Continued)

(58) Field of Classification Search
CPC ..... H01Q 1/22; H01Q 5/321; H01Q 1/38; H01Q 1/48; H01Q 9/42; H01Q 21/0006
(Continued)

(56) References Cited

U.S. PATENT DOCUMENTS

2015/0340757 A1* 11/2015 Rho ..... H01Q 1/46 343/702
2016/0164167 A1* 6/2016 Choi ..... H01Q 1/243 343/702
(Continued)

FOREIGN PATENT DOCUMENTS

CN 1518783 A 8/2004
CN 106910735 A 6/2017
(Continued)

OTHER PUBLICATIONS

International Search Report for related International Application No. PCT/KR2018/006883; action dated Sep. 21, 2018; (3 pages).
(Continued)

*Primary Examiner* — Huedung X Mancuso
(74) *Attorney, Agent, or Firm* — K&L Gates LLP

(57) ABSTRACT

A wireless communication chip having an internal antenna includes a substrate having first and second mounting regions; a wireless communication module molded on the first mounting region; and an antenna block mounted on the second mounting region to be electrically connected to the wireless communication module, wherein the antenna block includes a first antenna on the substrate; a connection element connected to the first antenna; an insulating layer on the first antenna and the connection element to cover the first antenna and the connection element; and a second antenna on the insulating layer such that a first surface of the second antenna is in contact with the insulating layer, and a second surface, which is a reverse surface of the first surface, is exposed to the outside of the wireless communication chip,
(Continued)

wherein the second antenna is electrically connected to the first antenna through the connection element.

16 Claims, 12 Drawing Sheets

(51) Int. Cl.

| | |
|---|---|
| ***H01Q 1/38*** | (2006.01) |
| ***H01Q 21/00*** | (2006.01) |
| ***H01Q 9/42*** | (2006.01) |
| ***H01Q 5/321*** | (2015.01) |
| *H01Q 9/04* | (2006.01) |
| *H01Q 1/24* | (2006.01) |

(52) U.S. Cl.
CPC ..... *H01Q 1/48* (2013.01); *H01Q 5/321* (2015.01); *H01Q 9/42* (2013.01); *H01Q 21/0006* (2013.01); *H01Q 1/2291* (2013.01); *H01Q 1/241* (2013.01); *H01Q 1/243* (2013.01); *H01Q 9/0421* (2013.01)

(58) Field of Classification Search
USPC ..... 343/848
See application file for complete search history.

(56) References Cited

U.S. PATENT DOCUMENTS

| | | | | |
|---|---|---|---|---|
| 2016/0197403 | A1* | 7/2016 | Choi | H01Q 1/243 343/700 MS |
| 2018/0034134 | A1* | 2/2018 | Dalmia | H01Q 5/49 |
| 2018/0261907 | A1* | 9/2018 | Ha | H01Q 9/42 |
| 2019/0020096 | A1* | 1/2019 | Kim | H01Q 21/0006 |

FOREIGN PATENT DOCUMENTS

| | | | | | |
|---|---|---|---|---|---|
| JP | 2014179821 | | | 9/2014 | |
| KR | 10-2006-0093580 | A | | 8/2006 | |
| KR | 10-2007-0096712 | A | | 10/2007 | |
| KR | 10-2007-0098020 | A | * | 10/2007 | H01Q 1/22 |
| KR | 10-2009-0098493 | A | * | 9/2009 | H01Q 9/04 |
| KR | 10-2009-0098494 | A | | 9/2009 | |
| KR | 100965334 | | | 6/2010 | |
| KR | 1020100131656 | A | | 12/2010 | |
| KR | 101360544 | | | 2/2014 | |

OTHER PUBLICATIONS

Chinese Office Action for related Chinese Application No. 201810784300.1; action dated Apr. 1, 2020; (13 pages).

* cited by examiner

WIRELESS COMMUNICATION CHIP HAVING INTERNAL ANTENNA, INTERNAL ANTENNA FOR WIRELESS COMMUNICATION CHIP, AND METHOD OF FABRICATING WIRELESS COMMUNICATION CHIP HAVING INTERNAL ANTENNA

CROSS-REFERENCE TO RELATED APPLICATION

Pursuant to 35 U.S.C. § 119(a), this application claims the benefit of earlier filing date and right of priority to Korean Patent Application No. 10-2017-0090274, filed on Jul. 17, 2017, the disclosure of which is incorporated herein by reference in its entirety.

BACKGROUND

1. Field of the Invention

The present invention relates to a communication module, and more particularly, to an antenna for a communication module.

2. Discussion of Related Art

Various electronic devices capable of performing communication functions include therein wireless communication chips, such as Bluetooth, WiFi, or a global positional system (GPS), and antennas combined with the wireless communication chips and configured to transmit communication data to the outside or receive the communication data from the outside, to perform the communication functions.

In an example, as shown in FIG. 1, in a typical electronic device 100, a wireless communication chip 120 and an antenna 130 configured to transmit and receive communication data may be mounted on a motherboard 110, and the wireless communication chip 120 and the antenna 130 may be electrically connected to each other through a radio-frequency (RF) cable 140.

However, as shown in FIG. 1, in the typical electronic device 100, since the wireless communication chip 120 and the antenna 130 are mounted as separate components, the RF cable 140 configured to connect the wireless communication chip 120 and the antenna 130 is necessarily required. Therefore, manufacturing costs increase, and it is difficult to miniaturize the electronic device 100.

In addition, since the antenna 130 is directly mounted on the motherboard 110, a resonance frequency of the antenna 130 may be changed according to a shape or size of the motherboard 110.

PRIOR-ART DOCUMENTS

Patent Documents

Korean Patent Publication No. 10-2010-0131656, published on Dec. 16, 2010 and entitled "Internal Antenna Module, Method of Fabricating the Module, and Wireless Communication Terminal Including the Module"

SUMMARY OF THE INVENTION

The present invention is directed to providing a wireless communication chip having an internal antenna, in which an antenna is not designed on a motherboard of an electronic device but designed to be embedded in a communication module, an internal antenna for a wireless communication chip, and a method of fabricating a wireless communication chip having an internal antenna.

In addition, the present invention is directed to providing a wireless communication chip having an internal antenna, in which a resonance frequency is variable, an internal antenna for a wireless communication chip, and a method of fabricating a wireless communication chip having an internal antenna.

According to an aspect of the present invention, there is provided a wireless communication chip having an internal antenna, the wireless communication chip including: a substrate including a first mounting region and a second mounting region; a wireless communication module molded on the first mounting region; and an antenna block mounted on the second mounting region to be electrically connected to the wireless communication module. The antenna block includes a first antenna formed on the substrate; a connection element connected to the first antenna; an insulating layer formed on the first antenna and the connection element to cover the first antenna and the connection element; and a second antenna formed on the insulating layer such that a first surface of the second antenna is in contact with the insulating layer, and a second surface of the second antenna, which is a reverse surface of the first surface, is exposed to the outside of the wireless communication chip. The second antenna is electrically connected to the first antenna through the connection element.

The first antenna may include a radiator pattern; a feeding pin formed to extend from one end of the radiator pattern in a second direction, which is different from a first direction that is a lengthwise direction of the radiator pattern, wherein the feeding pin is configured to supply a feeding signal supplied from the wireless communication module to the radiator pattern; and a first ground unit configured to ground the radiator pattern. In an exemplary embodiment, the radiator pattern may be formed as a meander line pattern.

In an exemplary embodiment, a distance between the feeding pin and the first ground unit may range from $0.02\lambda$ to $0.03\lambda$.

The first ground unit may include a branch unit branched from the feeding pin to the first direction; and a ground pin extending from one end of the branch unit in the second direction.

In an exemplary embodiment, the connection element may be connected to another end of the radiator pattern, and the first antenna may further include a second ground unit, which may extend from the connection element in the second direction to ground the connection element. The connection element may be a lumped element.

The wireless communication module and the insulating layer may be formed to have the same height.

Meanwhile, the connection element may be formed to have a predetermined height from a surface of the substrate, the first antenna may be electrically connected to a bottom surface of a first terminal of the connection element, and the second antenna may be electrically connected to a top surface of the first terminal of the connection element.

In this case, the second antenna may include a compression groove configured to electrically connect the second antenna to the top surface of the first terminal of the connection element.

According to another aspect of the present invention, there is provided an internal antenna for a wireless communication chip, the internal antenna including: a first antenna formed on a substrate; a connection element connected to the first antenna; an insulating layer formed on the first antenna and the connection element to cover the first antenna and the connection element; and a second antenna formed on the insulating layer such that a first surface of the second antenna is in contact with the insulating layer, and a second surface of the second antenna, which is a reverse surface of the first surface, is exposed to the outside. The second antenna may be electrically connected to the first antenna through the connection element.

According to still another aspect of the present invention, there is provided an electronic device including: a first substrate; a first antenna formed on the first substrate; and a wireless communication chip mounted on the first substrate and electrically connected to the first antenna. The wireless communication chip includes a second substrate including a first mounting region and a second mounting region; a wireless communication module molded on the first mounting region; and an antenna block mounted on the second mounting region to be electrically connected to the wireless communication module and the first antenna. The antenna block includes a connection element formed on the second mounting region of the second substrate and electrically connected to the first antenna; an insulating layer formed on the connection element to cover the connection element; and a second antenna electrically connected to the first antenna through the connection element and formed on the insulating layer such that a first surface of the second antenna is in contact with the insulating layer and a second surface of the second antenna, which is a reverse surface of the first surface, is exposed to the outside of the wireless communication chip.

In an exemplary embodiment, the first antenna may have an internal antenna, which may further include a radiator pattern; a feeding pin configured to extend from one end of the radiator pattern in a second direction and supply a feeding signal supplied from the wireless communication module to the radiator pattern, wherein the second direction is different from a first direction, which is a lengthwise direction of the radiator pattern; and a first ground unit configured to connect the radiator pattern to a ground line formed on the first substrate.

In this case, a first via hole may be formed in a region of the second substrate corresponding to another end of the radiator pattern and filled with a first conductor configured to electrically connect the other end of the radiator pattern to the connection element.

Meanwhile, a second via hole may be formed in a region of the second substrate corresponding to the feeding pin and filled with a second conductor configured to electrically connect the wireless communication module to the feeding pin.

According to yet another aspect of the present invention, there is provided a method of fabricating a wireless communication chip having an internal antenna, the method including: forming a chip constituting a wireless communication module and a circuit interconnection in a first mounting region of a substrate; forming a first antenna and a connection element in a second mounting region of the substrate; forming insulating layers and on an entire surface of the substrate; forming a second antenna on the insulating layer formed on the second mounting region; and electrically connecting the second antenna to the first antenna.

In this case, the electrically connecting of the second antenna to the first antenna may include compressing at least a portion of the second antenna to form a compression groove, such that the second antenna is connected to the connection element by passing through the insulating layer.

According to yet another aspect of the present invention, there is provided a method of fabricating an electronic device, the method including: forming a chip constituting a wireless communication module and a circuit interconnection on a first mounting region of a daughterboard; forming a connection element on a second mounting region of the daughterboard; forming insulating layers and on an entire surface of the daughterboard; forming a second antenna on the insulating layer formed on the second mounting region; electrically connecting the second antenna to the connection element to fabricate a wireless communication chip; and mounting the wireless communication chip on a motherboard on which a first antenna is formed, to electrically connect the wireless communication chip to the first antenna.

In this case, the method may further include forming a first via hole and a second via hole in the second mounting region of the daughterboard. The mounting of the wireless communication chip on the motherboard may include filling the first via hole with a first conductor to electrically connect the first antenna to the wireless communication module and filling the second via hole with a second conductor to electrically connect the first antenna to the connection element.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

The meanings of terms described herein should be understood as follows.

The singular forms "a," "an," and "the" are intended to include the plural forms as well, unless the context clearly indicates otherwise. Terms, such as "first," "second," and the like, may be used to distinguish one element or component from another element or component, and such elements or components should not be limited by these terms.

It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

The term "at least one of" includes any and all combinations of one or more of the associated listed items. For example, "at least one of a first item, a second item, and a third item" means not only the first item, the second item, or the third item each, but also any and all combinations of at least two of the first item, the second item, and the third item.

Embodiment 1

Figure 1:
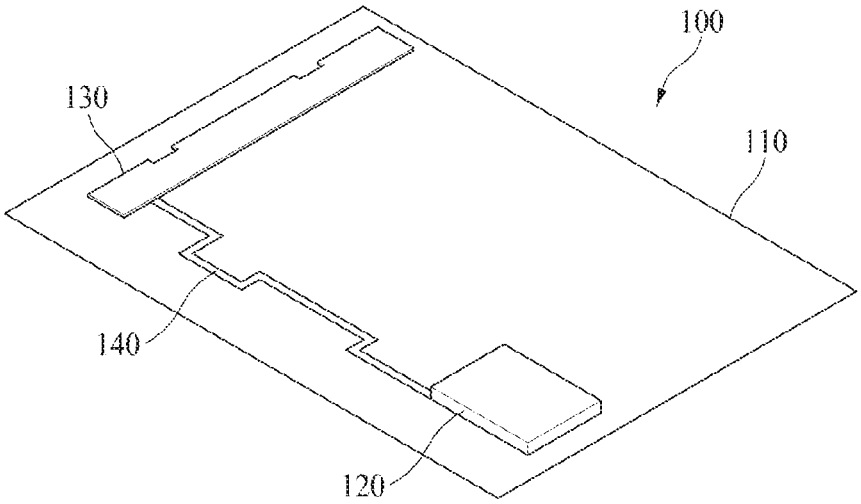
FIG. 1 is a schematic diagram of a configuration of a typical electronic device on which a wireless communication chip and an antenna are mounted as separate components.
Figure 2A:
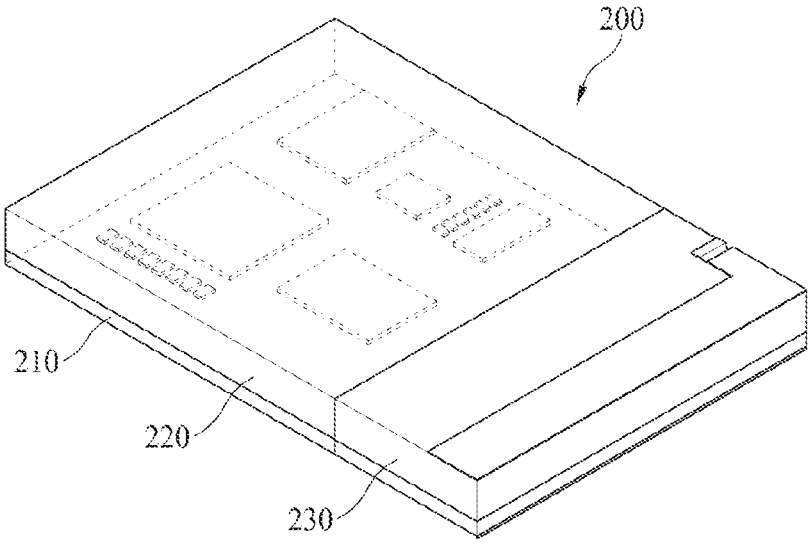
FIG. 2A is a perspective view of a wireless communication chip according to a first exemplary embodiment of the present invention.
Figure 2B:
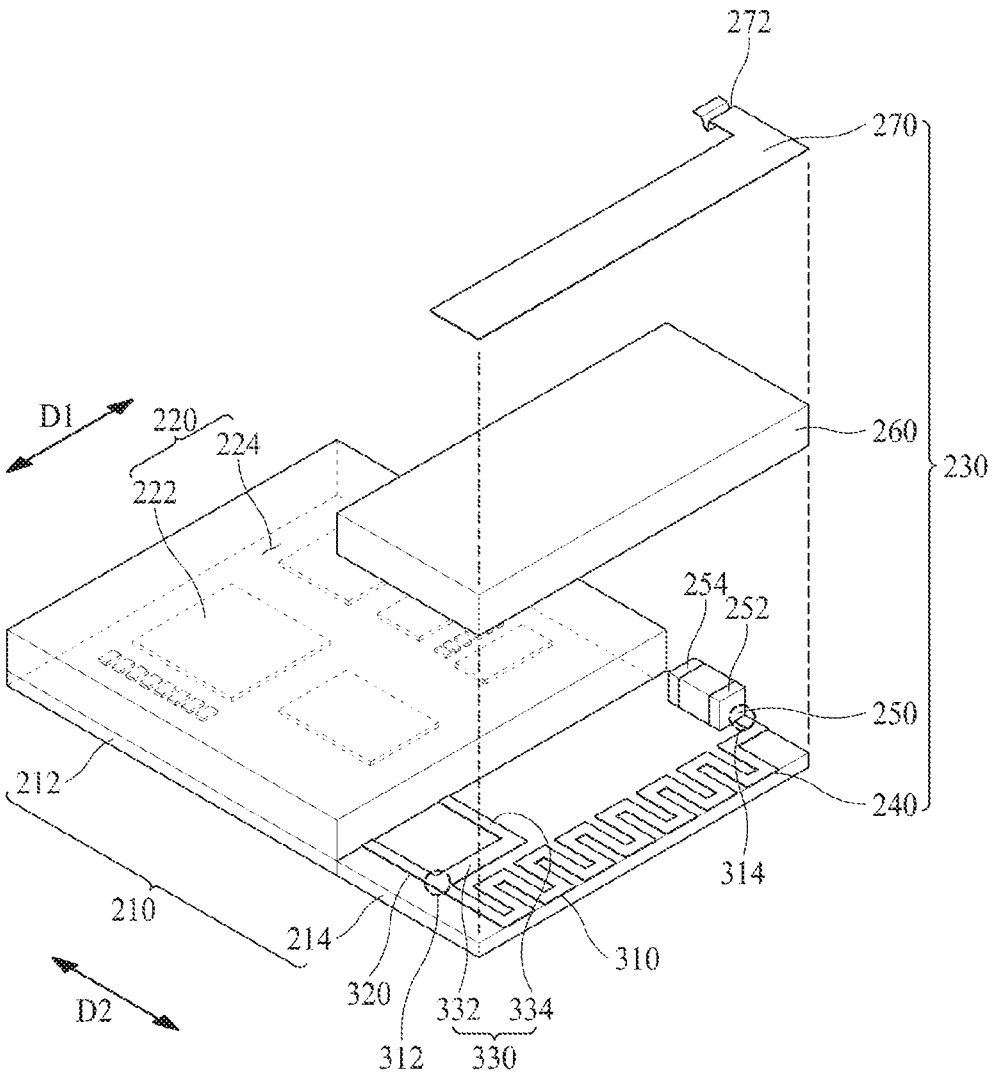
FIG. 2B is a partial exploded perspective view of the wireless communication chip according to the first exemplary embodiment of the present invention.
Figure 3:
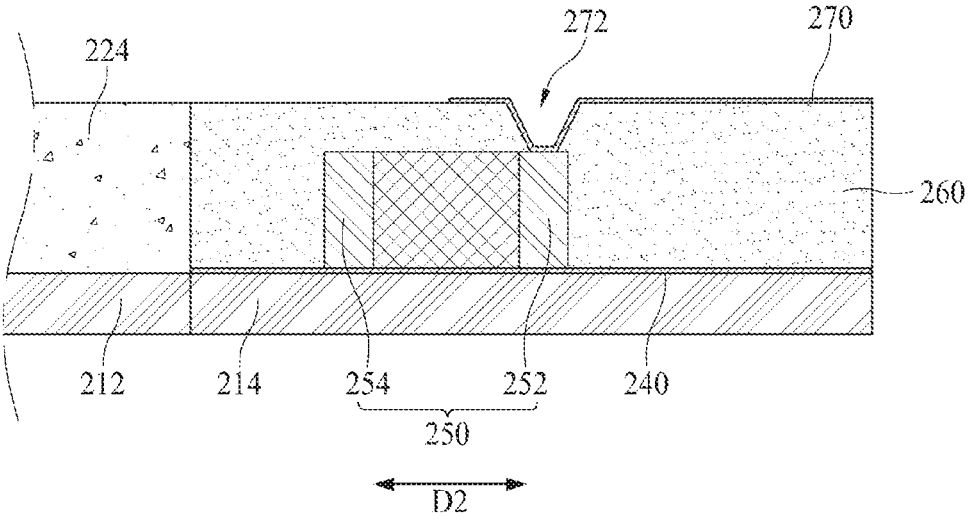
FIG. 3 is a side view of the wireless communication chip according to the first exemplary embodiment of the present invention.
Figure 4:
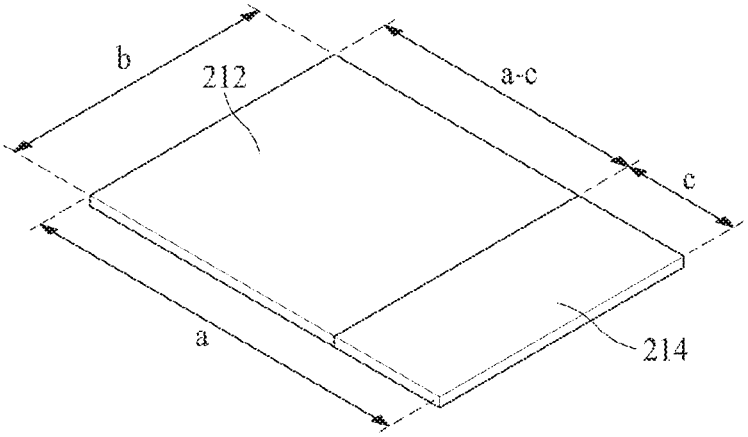
FIG. 4 is diagrams showing sizes of a first mounting region and a second mounting region according to an exemplary embodiment of the present invention.
Figure 5A:
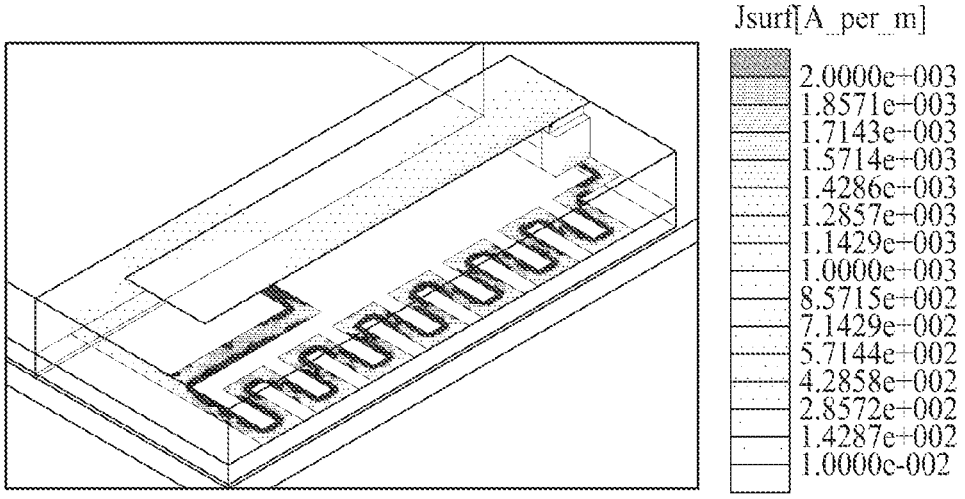
FIGS. 5A and 5B are a diagram showing a current distribution of a wireless communication chip according to an exemplary embodiment of the present invention.
Figure 5B:
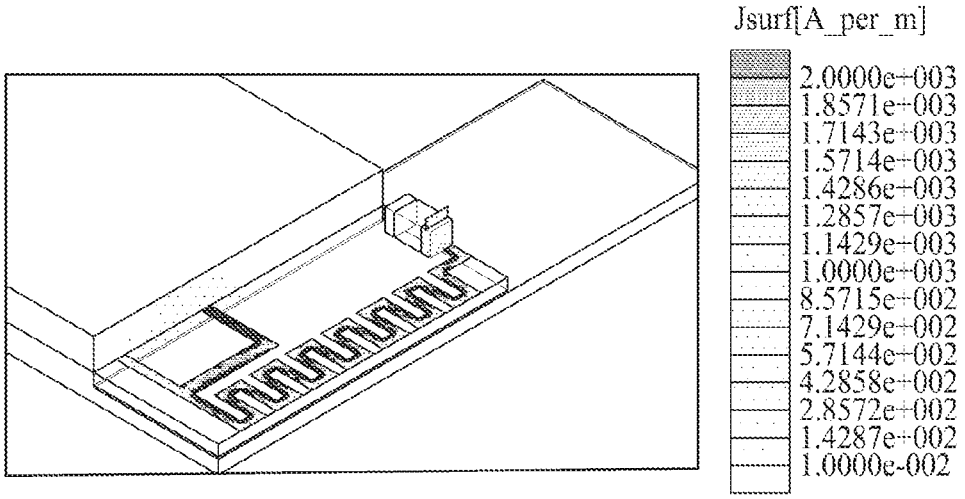

Hereinafter, a first exemplary embodiment of the present invention will be described in detail with reference to FIGS. 2A to 5B. FIG. 2A is a perspective view of a wireless communication chip according to a first exemplary embodiment of the present invention. FIG. 2B is a partial exploded perspective view of the wireless communication chip according to the first exemplary embodiment of the present invention. FIG. 3 is a side view of the wireless communication chip according to the first exemplary embodiment of the present invention. FIG. 4 is diagrams showing sizes of a first mounting region and a second mounting region according to an exemplary embodiment of the present invention. FIGS. 5A and 5B are a diagram showing a current distribution of a wireless communication chip according to an exemplary embodiment of the present invention;

As shown in FIGS. 2A, 2B, and 3, a wireless communication chip 200 according to the first exemplary embodiment of the present invention may be mounted on a motherboard (not shown) of an electronic device to implement a communication function of the electronic device.

In an exemplary embodiment, the wireless communication chip 200 according to the present invention may be a near-field communication chip, such as Bluetooth, WiFi, Beacon, or NFC, which may enable near-field communications. However, the present invention is not limited thereto, and the wireless communication chip 200 according to the present invention may be a communication chip, such as 3G, 4G, or 5G, which may enable wireless communications.

As shown in FIGS. 2A and 2B, the wireless communication chip 200 according to the present invention may include a substrate 210, a wireless communication module 220, and an antenna block 230.

The wireless communication module 220 and the antenna block 230 may be mounted on the substrate 210. In an exemplary embodiment, the substrate 210 may be a printed circuit board (PCB). As shown in FIGS. 2A and 2B, the substrate 210 according to the present invention may include a first mounting region 212 on which the wireless communication module 220 is mounted and a second mounting region 214 on which the antenna block 230 is mounted. In this case, the first mounting region 212 and the second mounting region 214 may be formed to have smaller lengths in a first direction D1 than in a second direction D2.

In an exemplary embodiment, the first mounting region 212 may be formed to have a larger area than that of the second mounting region 214. For example, as shown in FIG. 4, when a first side a of the substrate 210 has a length of 6.5 mm and a second side b of the substrate 210 has a length of 6.5 mm, the first mounting region 212 on which the wireless communication module 220 is mounted may have a first side a-c with a size of 5.0 mm and a second side b with a size of 6.5 mm, and the second mounting region 214 on which the antenna block 230 is mounted may have a first side c with a size of 1.5 mm and a second side b with a size of 6.5 mm.

The wireless communication module 220 may be molded on the first mounting region 212 of the substrate 210. In an exemplary embodiment, the wireless communication module 220 may be a near-field communication module, such as Bluetooth, WiFi, Beacon, or NFC, or a communication module, such as 3G, 4G, or 5G.

The wireless communication module 220 may include a circuit interconnection (not shown) patterned on the first mounting region 212 of the substrate 210, a baseband chip/RF chip 222 mounted on the first mounting region 212 of the substrate 210 to be electrically connected to the circuit interconnection to implement a communication function, and an insulating layer 224 configured to cover the baseband chip/RF chip 222.

The antenna block 230 may be electrically connected to the wireless communication module 220 and transmit communication data supplied from the wireless communication module 220 to the outside or receive communication data received from the outside. The antenna block 230 may radiate communication data to the outside or receive communication data received from the outside, by using an electric signal (e.g., current) that is fed from the wireless communication module 220.

In an exemplary embodiment, as shown in FIGS. 2A, 2B, and 3, the antenna block 230 according to the present invention may include a first antenna 240, a connection element 250, an insulating layer 260, and a second antenna 270.

The first antenna 240 may be formed on the substrate 210 to be electrically connected to the wireless communication module 220. The first antenna 240 may be patterned and formed on the substrate 210. In an exemplary embodiment, the first antenna 240 may be patterned along with the circuit interconnection designed on the first mounting region 212.

As shown in FIGS. 2A, 2B, and 3, the first antenna 240 according to the present invention may include a radiator pattern 310, a feeding pin 320, and a first ground unit 330.

The radiator pattern 310 may be formed on the second mounting region 214 of the substrate 210 to have a predetermined length. In this case, a length of the radiator pattern 310 may be determined according to a desired resonance frequency band. The radiator pattern 310 may be bent at least once to implement a desired resonance frequency band. That is, the radiator pattern 310 according to the present invention may be formed as a meander line pattern.

In an exemplary embodiment, the radiator pattern 310 may be formed on the second mounting region 214 of the substrate 210 and extend in the first direction D1.

The feeding pin 320 may supply an electric signal supplied from the wireless communication module 220 to the radiator pattern 310. In an exemplary embodiment, the feeding pin 320 may be formed to extend from one end 312 of the radiator pattern 310 in the second direction D2.

The first ground unit 330 may ground the radiator pattern 310. To ground the radiator pattern 310, the first ground unit 330 may electrically connect the radiator pattern 310 to a ground unit (not shown) included in the wireless communication module 220.

In an exemplary embodiment, the first ground unit 330 may be branched from the feeding pin 320. According to this exemplary embodiment, as shown in FIGS. 2A and 2B, the first ground unit 330 may include a branch unit 332 and a ground pin 334.

The branch unit 332 may be formed to extend from the feeding pin 320 in the first direction D1. The ground pin 334 may be formed to extend from one end of the branch unit 332 in the second direction D2. The ground pin 334 may be electrically connected to the ground unit included in the wireless communication module 220. That is, one end of the ground pin 334 may be connected to the branch unit 332, while another end of the ground pin 334 may be electrically connected to the ground unit included in the wireless communication module 220.

In the above-described embodiment, a length of the branch unit 332 may be set as such a value that a current distribution concentrates in the branch unit 332 and the ground pin 334. For example, the length of the branch unit 332 may be set to be 0.02λ to 0.03λ. Thus, the feeding pin 320 may be spaced apart from the ground pin 334 by a distance of 0.02λ to 0.03λ. A current distribution obtained when the feeding pin 320 is spaced apart from the ground pin 334 by the distance of 0.02λ to 0.03λ is illustrated in FIGS. 5A and 5B. As can be seen from FIGS. 5A and 5B, when the feeding pin 320 is spaced apart from the ground pin 334 by the distance of 0.02λ to 0.03λ, the current distribution may concentrate in an inner portion of the radiator pattern 310, the branch unit 332, and the ground pin 334.

Referring back to FIGS. 2A, 2B and 3, the connection element 250 may electrically connect the first antenna 240 and the second antenna 270. The connection element 250 may be formed on the substrate 210 and protrude in the second direction D2 from another end 314 of the radiator pattern 310 included in the first antenna 240.

In an exemplary embodiment, the connection element 250 may be implemented as a lumped element. According to the present exemplary embodiment, the first antenna 240 and the second antenna 270 may be connected to a first terminal 252 of the connection element 250, and a second terminal 254 of the connection element 250 may be floated. When the connection element 250 is implemented as the lumped element, the connection element 250 may be formed to have a predetermined height from a surface of the substrate 210. Thus, the radiator pattern 310 of the first antenna 240 may be connected to a bottom surface of the first terminal 252 of the connection element 250, and the second antenna 270 may be connected to a top surface of the first terminal 252 of the connection element 250 so that the first antenna 240 may be electrically connected to the second antenna 270.

The insulating layer 260 may be formed on the second mounting region 214 of the substrate 210 to cover the first antenna 240 and the connection element 250. The insulating layer 260 may be formed to have such a thickness as not to expose the first antenna 240 and the connection element 250 to the outside. Thus, the antenna block 230 according to the present invention may protect the first antenna 240 and the connection element 250 using only the insulating layer 260 without an additional external case.

Meanwhile, the insulating layer 260 may be formed to have the same height as that of the insulating layer 224 included in the wireless communication module 220. In this case, the insulating layer 260 may be formed together with the insulating layer 224 of the wireless communication module 220.

In an exemplary embodiment, the insulating layer 260 may be formed of epoxy. In another exemplary embodiment, the insulating layer 260 may be formed of a high-k dielectric material (e.g., a ceramic material) having a dielectric constant equal to or higher than a reference value.

The second antenna 270 may be formed on the insulating layer 260 to be electrically connected to the first antenna 240 through the connection element 250. As described above, the second antenna 270 may be electrically connected to the first antenna 240 so that a length of the first antenna 240 may be extended by as much as a length of the second antenna 270. In an exemplary embodiment, the second antenna 270 may be formed on the insulating layer 260 and extend in the first direction D1, and a distance between the second antenna 270 and the substrate 210 may range from 0.2λ to 0.3λ.

In this case, a first surface of the second antenna 270 may be in contact with the insulating layer 260, and a second surface of the second antenna 270, which is a reverse surface of the first surface, may be exposed outside the wireless communication chip 200. That is, in the present invention, the second antenna 270 of the antenna block 230 may be disposed in an outermost region of the antenna block 230 and exposed to the outside.

In a case where the first antenna 240 is disposed on a bottom surface of the substrate 210 and the second antenna 270 is disposed on a top surface of the substrate 210, a via hole configured to electrically connect the first antenna 240 to the second antenna 270 should be formed in the substrate 210. In this case, however, since a thickness of the substrate 210 is small, it may be difficult to directly form the via hole in the substrate 210. Accordingly, in the above-described embodiment, the first antenna 240, the insulating layer 260, and the second antenna 270 may be disposed in a stacked structure on the top surface of the substrate 210.

Accordingly, in the present invention, the first antenna 240, the insulating layer 260, and the second antenna 270 may be disposed in a stacked structure on the top surface of the substrate 210. Thus, the first and second antennas 240 and 270 may be electrically connected to each other without forming a via hole in the substrate 210. Further, not only a distance between the second antenna 270 and the first antenna 240 but also a distance between the second antenna 270 and the first ground unit 330 may be obtained to improve antenna performance.

In an exemplary embodiment, as shown in FIGS. 2A, 2B, and 3, the second antenna 270 may include a compression groove 272 configured to electrically connect the second antenna 270 to the connection element 250. The reason why the second antenna 270 according to the present invention includes the compression groove 272 may be as follows. When a height of the connection element 250 is smaller than that of the insulating layer 260, since the connection element 250 is not exposed to the outside, the second antenna 270 formed on the insulating layer 260 cannot be connected to the connection element 250. Therefore, a portion of the second antenna 270 may be compressed to form the compression groove 272, so that the second antenna 270 may be connected to the connection element 250 by passing through the insulating layer 260.

According to the present embodiment, the compression groove 272 of the second antenna 270 may be connected to the top surface of the first terminal 252 of the connection element 250.

In the above-described exemplary embodiment, since the connection element 250 is formed to have a smaller height than that of the insulating layer 260, the second antenna 270 may have the compression groove 272 to connect the second antenna 270 with the connection element 250. However, in another exemplary embodiment, when the height of the connection element 250 is equal to or greater than that of the insulating layer 260 and the top surface of the first terminal 252 of the connection element 250 is exposed to the outside, the second antenna 270 may be directly connected to the top surface of the first terminal 252 of the connection element 250 without the separate compression groove 272. Accordingly, the compression groove 272 may be selectively provided according to the heights of the connection element 250 and the insulating layer 260.

In an exemplary embodiment, a resonance frequency of the second antenna 270 may be equal to a resonance frequency of the first antenna 240. Thus, interference that may occur between the second antenna 270 and the first antenna 240 may be prevented.

As described above, according to the present invention, since the antenna block 230 is mounted in the wireless communication chip 200, when the wireless communication chip 200 is mounted on a motherboard, an additional RF cable configured to connect the wireless communication chip 200 with an antenna is not required so that manufacturing costs may be reduced, and integration density may be increased on the motherboard. Therefore, the electronic device may be miniaturized, and easiness of a circuit interconnection on the motherboard may be enhanced to increase the convenience of manufacturing operations.

Furthermore, according to the present invention, since the antenna block 230 is not directly designed on the motherboard of the electronic device but mounted in the wireless communication chip 200, a resonance frequency of an antenna may be prevented from varying according to a shape or size of the motherboard.

Embodiment 2

In the first embodiment, even in a case where the connection element 250 constituting the antenna block 230 is implemented as a lumped element, the first terminal 252 of the connection element 250 may be electrically connected to the first antenna 240 and the second antenna 270, and the second terminal 254 of the connection element 250 may be floated.

Figure 6:
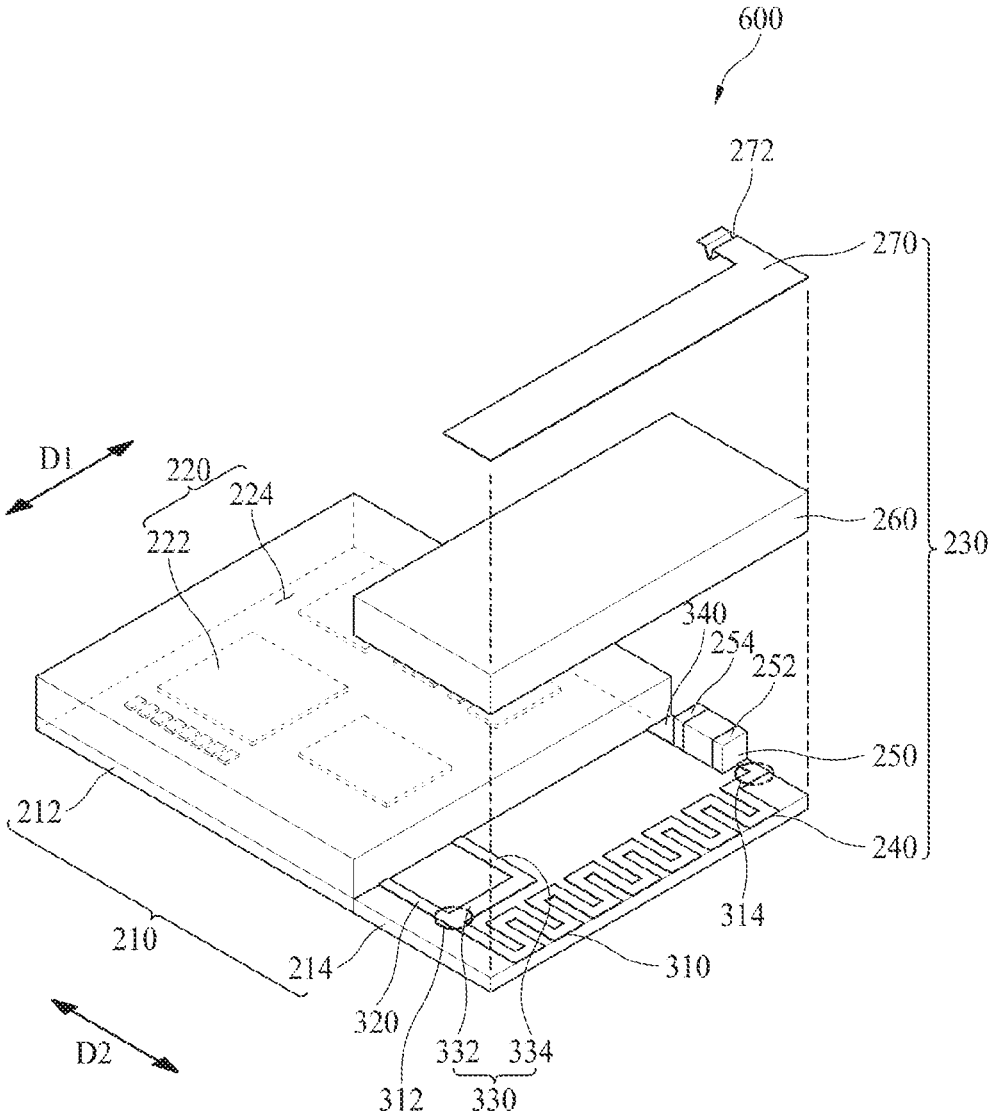
FIG. 6 is a partial exploded perspective view of a wireless communication chip according to a second exemplary embodiment of the present invention.

However, an antenna block 230 according to a second exemplary embodiment may further include a second ground unit 340 configured to ground a connection element 250 as shown in FIG. 6 to change a resonance frequency of the antenna block 230 using the connection element 250 that is implemented as a lumped element.

A wireless communication chip 600 shown in FIG. 6, according to the second exemplary embodiment, is the same as the wireless communication chip 200 shown in FIGS. 2A and 2B, according to the first exemplary embodiment, except that the wireless communication chip 600 includes the second ground unit 340. Therefore, only the second ground unit 340 will now be described for brevity.

The second ground unit 340 may electrically connect the connection element 250 to a ground unit (not shown) included in a wireless communication module 220 and ground the connection element 250. To this end, the second ground unit 340 may extend from a second terminal 254 of the connection element 250 in a second direction D2.

As described above, according to the second exemplary embodiment of the present invention, the connection element 250 may be implemented as a lumped element including at least one of an inductor, a capacitor, and a resistor, a first terminal 252 of the connection element 250 may be connected to a first antenna 240 and a second antenna 270, and the second terminal 254 of the connection element 250 may be grounded through the second ground unit 340. Thus, since a resonance frequency of the antenna block 230 is variable according to a value of a circuit element constituting the connection element 250, the antenna block 230 may be applied to various applications without adding a separate component or changing components.

In the second embodiment, like in the first embodiment, the first antenna 240, an insulating layer 260, and the second antenna 270 may be disposed in a stacked structure on a top surface of a substrate 210. Thus, the first and second antennas 240 and 270 may be electrically connected to each other without forming a via hole in the substrate 210. Further, not only a distance between the second antenna 270 and the first antenna 240 but also distances between the second antenna 270 and the first and second ground units 330 and 340 may be secured to improve antenna performance.

Embodiment 3

In the first and second exemplary embodiments, both the first antenna 240 and the second antenna 270 have been described as being included in the wireless communication chip 200. However, a wireless communication chip according to a third exemplary embodiment may include only a second antenna 270, and a first antenna 240 may be directly formed on a motherboard of an electronic device. Hereinafter, the electronic device including the wireless communication chip according to the third exemplary embodiment of the present invention will be described with reference to FIGS. 7A, 7B, and 8.

Figure 7A:
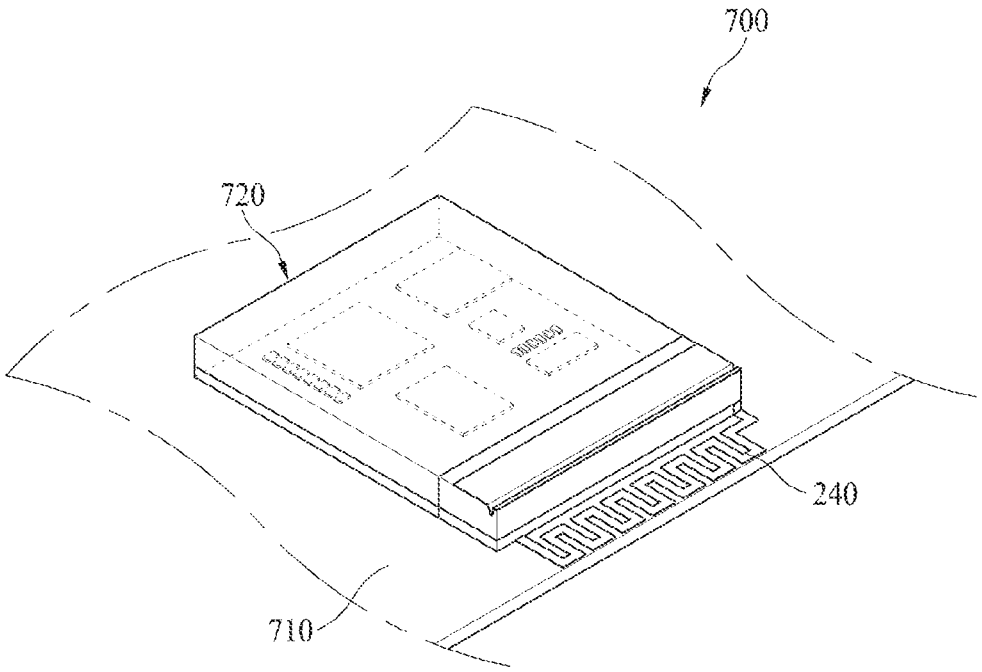
FIG. 7A is a perspective view of an electronic device including a wireless communication chip according to a third exemplary embodiment of the present invention.
Figure 7B:
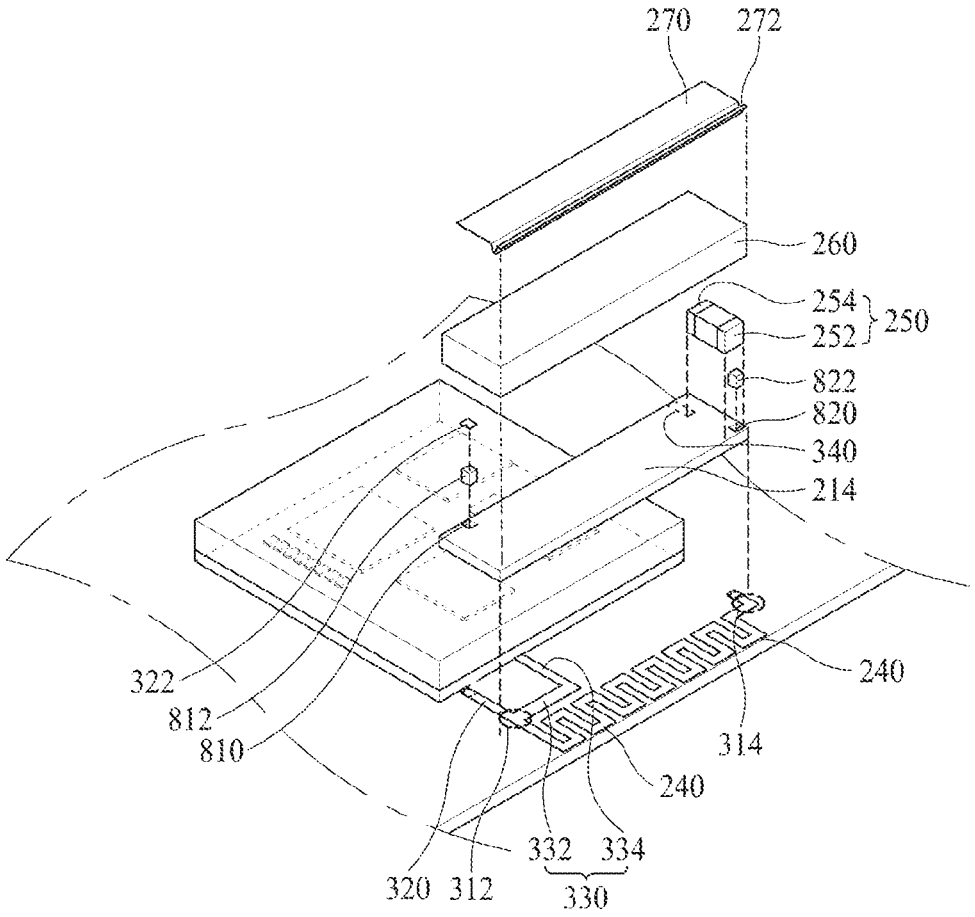
FIG. 7B is a partial exploded perspective view of the electronic device including the wireless communication chip according to the third exemplary embodiment of the present invention.
Figure 8:
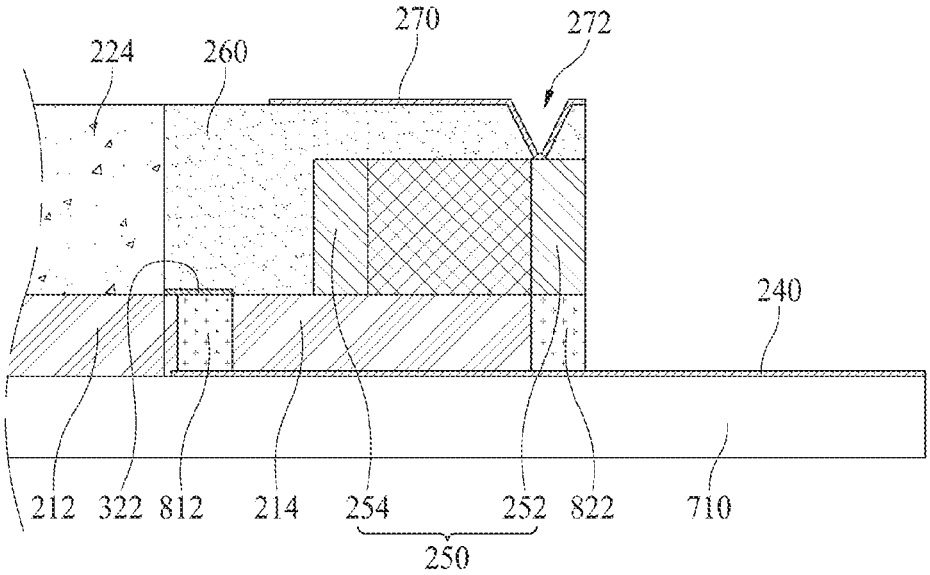
FIG. 8 is a side view of the electronic device including the wireless communication chip according to the third exemplary embodiment of the present invention.

FIG. 7A is a perspective view of an electronic device on which the wireless communication chip according to the third exemplary embodiment of the present invention is mounted. FIG. 7B is an exploded perspective view of the electronic device on which the wireless communication chip according to the third exemplary embodiment of the present invention is mounted. FIG. 8 is a side view of the wireless communication chip according to the third exemplary embodiment of the present invention.

As shown in FIGS. 7A, 7B, and 8, an electronic device 700 may include a motherboard 710, a wireless communication chip 720, and a first antenna 240.

Various chips (not shown) configured to implement functions of the electronic device 700 may be mounted on the motherboard 710. In particular, the wireless communication chip 720 according to the third exemplary embodiment of the present invention may be mounted on the motherboard 710 according to the present invention, and the first antenna 240 according to the present invention may be formed on the motherboard 710. That is, the first and second exemplary embodiments describe a case in which the first antenna 240 is included in the wireless communication chip 200, while the third exemplary embodiment describe a case in which the first antenna 240 is not included in the wireless communication chip 720 but directly formed on the motherboard 710.

The wireless communication chip 720 may be mounted on a predetermined region of the motherboard 710 so that the electronic device 700 may perform a communication function. In an exemplary embodiment, the wireless communication chip 720 may be a near-field communication chip, such as Bluetooth, WiFi, Beacon, or NFC, which may enable near-field communications. However, the present invention is not limited thereto, and the wireless communication chip 720 according to the present invention may be a communication chip, such as 3G, 4G, or 5G, which may enable wireless communications.

Figure 9A:
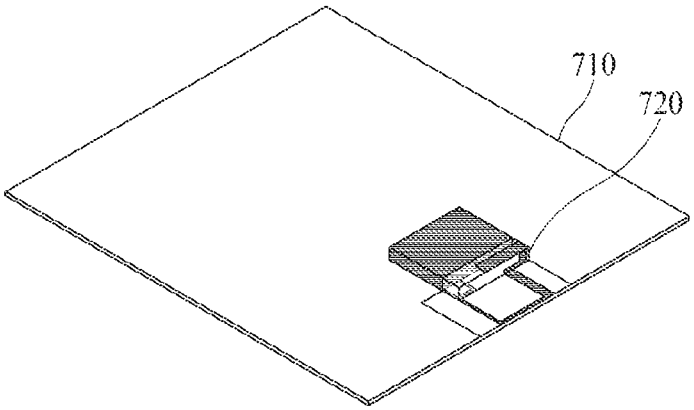
FIG. 9A is a diagram of an example in which a wireless communication chip according to the present invention is mounted on the center of one side of a motherboard.
Figure 9B:
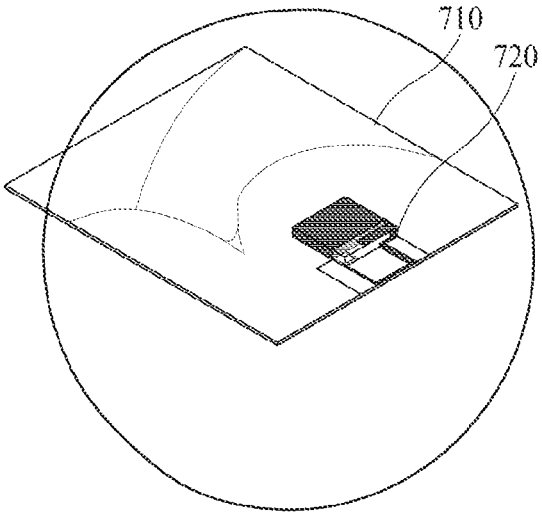
FIG. 9B is a diagram of a radiation pattern obtained in the example of FIG. 9A.
Figure 10A:
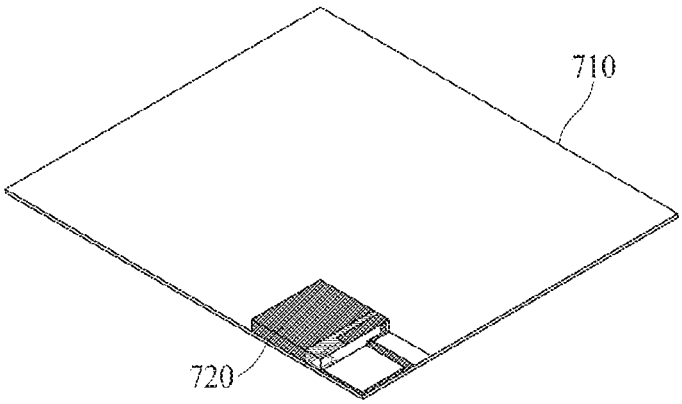
FIG. 10A is a diagram of an example in which a wireless communication chip according to the present invention is mounted on a corner of a motherboard.
Figure 10B:
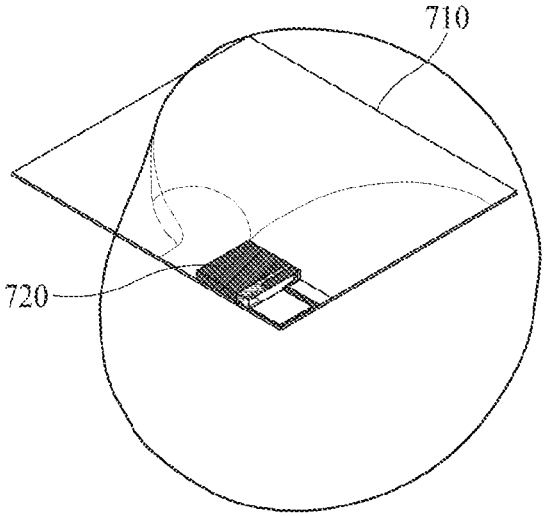
FIG. 10B is a diagram of a radiation pattern obtained in the example of FIG. 10A.

In an exemplary embodiment, the wireless communication chip 720 may be mounted on a central region of one side of the motherboard 710 as shown in FIG. 9A or mounted on a corner portion of the motherboard 710 as shown in FIG. 10A. When the wireless communication chip 720 is mounted on the central region of the one side of the motherboard 710, a radiation pattern may be as shown in FIG. 9B. When the wireless communication chip 720 is mounted on the corner portion of the motherboard 710, the radiation pattern may be as shown in FIG. 10B. As can be seen from FIGS. 9B and 10B, it can be seen that when the wireless communication chip 720 is mounted on the central region of the one side of the motherboard 710, more uniform radiation patterns may be obtained than when the wireless communication chip 720 is mounted on the corner portion of the motherboard 710.

The wireless communication chip 720 according to the third exemplary embodiment of the present invention may include a daughterboard 210, a wireless communication module 220, and an antenna block 230, and the antenna block 230 may include a connection element 250, an insulating layer 260, and a second antenna 270. Here, the daughterboard 210 may be synonymous with the substrate 210 of the first and second exemplary embodiments.

The wireless communication module 220 and the antenna block 230 may be mounted on the daughterboard 210. In an exemplary embodiment, the daughterboard 210 may be a printed circuit board (PCB). The daughterboard 210 according to the present invention may include a first mounting region 212 on which the wireless communication module 220 is mounted and a second mounting region 214 on which the antenna block 230 is mounted. In this case, the first mounting region 212 and the second mounting region 214 may be formed to have smaller lengths in a first direction D1 than in a second direction D2.

In an exemplary embodiment, as shown in FIG. 7B, a first via hole 810 may be formed in the daughterboard 210 to connect the first antenna 240 with the wireless communication module 220.

As shown in FIGS. 7B and 8, the first via hole 810 may be filled with a first conductor 812 to electrically connect the wireless communication module 220 with the first antenna 240. In this case, as shown in FIG. 7B, a sub-feeding pin 322 may be formed on the daughterboard 210 to electrically connect the first via hole 810 with the wireless communication module 220.

In addition, as shown in FIG. 7B, a second via hole 820 may be further formed in the daughterboard 210 to connect the first antenna 240 with the connection element 250. As shown in FIGS. 7B and 8, the second via hole 820 may be filled with a second conductor 822 to electrically connect the connection element 250 with the first antenna 240.

As described above, in the third exemplary embodiment, since the first antenna 240 is directly formed on the motherboard 710, the wireless communication chip 720 and the first antenna 240 may be electrically connected to each other through the first and second via holes 810 and 820 formed in the daughterboard 210.

The wireless communication module 220 may be molded on the first mounting region 212 of the daughterboard 210. In an exemplary embodiment, the wireless communication module 220 may be a near-field communication module, such as Bluetooth, WiFi, Beacon, or NFC, or a communication module, such as 3G, 4G, or 5G.

The wireless communication module 220 may include a circuit interconnection (not shown) patterned on the first mounting region 212 of the daughterboard 210, a baseband chip/RF chip 222 mounted on the first mounting region 212 of the daughterboard 210 to be electrically connected to the circuit interconnection to implement a communication function, and an insulating layer 224 configured to cover the baseband chip/RF chip 222.

The antenna block 230 may be electrically connected to the wireless communication module 220 and transmit communication data supplied from the wireless communication module 220 to the outside or receive communication data received from the outside. The antenna block 230 may radiate communication data to the outside or receive communication data received from the outside using an electric signal (e.g., current) that is fed from the wireless communication module 220.

As shown in FIGS. 7A, 7B, and 8, the antenna block 230 may include a connection element 250, an insulating layer 260, and a second antenna 270.

The connection element 250 may be formed on the second mounting region 214 of the daughterboard 210 and electrically connect the second antenna 270 to the first antenna 240 formed on the motherboard 710. As described above, the connection element 250 may be electrically connected to another end 314 of the first antenna 240 formed on the motherboard 710, through the second via hole 820.

In an exemplary embodiment, the connection element 250 may be implemented as a lumped element. According to the present embodiment, the first antenna 240 and the second antenna 270 may be connected to a first terminal 252 of the connection element 250, and a second terminal 254 of the connection element 250 may be floated or electrically connected to a ground unit of the wireless communication module 220 through a second ground unit 340. When the second terminal 254 of the connection element 250 is electrically connected to the ground unit of the wireless communication module 220 through the second ground unit 340, a resonance frequency band of an antenna may be changed by adjusting a value of a circuit element included in the lumped element. In this case, the second ground unit 340 may extend from the second terminal 254 of the connection element 250 in the second direction D2 and be electrically connected to the ground unit included in the wireless communication module 220.

When the connection element 250 is implemented as the lumped element, the connection element 250 may be formed to have a predetermined height from the surface of the daughterboard 210. Thus, a bottom surface of the first terminal 252 of the connection element 250 may be connected to a radiator pattern 310 of the first antenna 240 through the second via hole 820, and a top surface of the first terminal 252 of the connection element 250 may be connected to the second antenna 270 so that the first antenna 240 may be electrically connected to the second antenna 270.

The insulating layer 260 may be formed on the second mounting region 214 of the daughterboard 210 to cover the connection element 250. The insulating layer 260 may be formed to have such a thickness as not to expose the connection element 250 to the outside. Thus, the antenna block 230 according to the present invention may protect the connection element 250 using only the insulating layer 260 without an additional external case.

Meanwhile, the insulating layer 260 may be formed to have the same height as that of the insulating layer 224 included in the wireless communication module 220. In this case, the insulating layer 260 may be formed together with the insulating layer 224 of the wireless communication module 220.

In an exemplary embodiment, the insulating layer 260 may be formed of epoxy. In another exemplary embodiment, the insulating layer 260 may be formed of a high-k dielectric material (e.g., a ceramic material) having a dielectric constant equal to or higher than a reference value.

The second antenna 270 may be formed on the insulating layer 260 to be electrically connected to the first antenna 240 through the connection element 250. As described above, the second antenna 270 may be electrically connected to the first antenna 240 so that a length of the first antenna 240 may be extended by as much as a length of the second antenna 270. In an exemplary embodiment, the second antenna 270 may be formed on the insulating layer 260 and extend in the first direction D1, and a distance between the second antenna 270 and the daughterboard 210 may range from 0.2λ to 0.3λ.

In this case, a first surface of the second antenna 270 may be in contact with the insulating layer 260, and a second surface of the second antenna 270, which is a reverse surface of the first surface, may be exposed outside the wireless communication chip 720. That is, in the present invention, the second antenna 270 of the antenna block 230 may be disposed in an outermost region of the antenna block 230 and exposed to the outside.

In an exemplary embodiment, as shown in FIGS. 7A, 7B, and 8, the second antenna 270 may include a compression groove 272 configured to electrically connect the second antenna 270 to the connection element 250. The reason why the second antenna 270 according to the present invention includes the compression groove 272 is as follows. When a height of the connection element 250 is smaller than that of the insulating layer 260, since the connection element 250 is not exposed to the outside, the second antenna 270 formed on the insulating layer 260 cannot be connected to the connection element 250. Therefore, a portion of the second antenna 270 may be compressed to form the compression groove 272, so that the second antenna 270 may be connected to the connection element 250 by passing through the insulating layer 260.

According to the present embodiment, the compression groove 272 of the second antenna 270 may be connected to the top surface of the first terminal 252 of the connection element 250.

In the above-described exemplary embodiment, since the connection element 250 is formed to have a smaller height than that of the insulating layer 260, the second antenna 270 may have the compression groove 272 to connect the second antenna 270 with the connection element 250. However, in another exemplary embodiment, when the height of the connection element 250 is equal to or greater than that of the insulating layer 260 and the top surface of the first terminal 252 of the connection element 250 is exposed to the outside, the second antenna 270 may be directly connected to the top surface of the first terminal 252 of the connection element 250 without the separate compression groove 272. Accordingly, the compression groove 272 may be selectively provided according to the heights of the connection element 250 and the insulating layer 260.

The first antenna 240 may be directly formed on the motherboard 710. The first antenna 240 may be formed on the motherboard 710 to be electrically connected to the wireless communication module 220 and the second antenna 270 of the antenna block 230. The first antenna 240 may be patterned and formed on the motherboard 710.

In an exemplary embodiment, the first antenna 240 may include a radiator pattern 310, a feeding pin 320, and a first ground unit 330.

The radiator pattern 310 may be formed on the motherboard 710 to have a predetermined length. In this case, a length of the radiator pattern 310 may be determined according to a desired resonance frequency band. The radiator pattern 310 may be bent at least once to implement a desired resonance frequency band. That is, the radiator pattern 310 according to the present invention may be formed as a meander line pattern.

In an exemplary embodiment, the radiator pattern 310 may be formed on the motherboard 710 and extend in the first direction D1.

The feeding pin 320 may be electrically connected to the wireless communication module 220 through the first via hole 810 and the sub-feeding pin 322, and supply an electric signal supplied from the wireless communication module 220 to the radiator pattern 310. In an exemplary embodiment, the feeding pin 320 may be formed to extend from one end 312 of the radiator pattern 310 in the second direction D2.

The first ground unit 330 may ground the radiator pattern 310. To ground the radiator pattern 310, the first ground unit 330 may electrically connect the radiator pattern 310 to a ground unit (not shown) formed on the motherboard 710.

In an exemplary embodiment, the first ground unit 330 may be branched from the feeding pin 320. According to this exemplary embodiment, as shown in FIGS. 7A and 7B, the first ground unit 330 may include a branch unit 332 and a ground pin 334.

The branch unit 332 may extend from the feeding pin 320 in the first direction D1. The ground pin 334 may extend from one end of the branch unit 332 in the second direction D2. The ground pin 334 may be electrically connected to the ground unit formed on the motherboard 710. That is, one end of the ground pin 334 may be connected to the branch unit 332, while another end of the ground pin 334 may be electrically connected to the ground unit of the motherboard 710.

In the above-described embodiment, a length of the branch unit 332 may be set as such a value that a current distribution concentrates in the branch unit 332 and the ground pin 334. For example, the length of the branch unit 332 may be set to be 0.02λ to 0.03λ. Thus, the feeding pin 320 may be spaced apart from the ground pin 334 by a distance of 0.02λ to 0.03λ.

In an exemplary embodiment, a resonance frequency of the first antenna 240 may be equal to a resonance frequency of the second antenna 270. Thus, interference that may occur between the first antenna 240 and the second antenna 270 may be prevented.

As described above, according to the third exemplary embodiment of the present invention, the first antenna 240 formed on the motherboard 710 may be electrically connected to the antenna block 230 embedded in the wireless communication chip 720 to improve radiation intensity.

Hereinafter, a method of fabricating a wireless communication chip according to the present invention will briefly be described with reference to FIG. 11.

Figure 11:
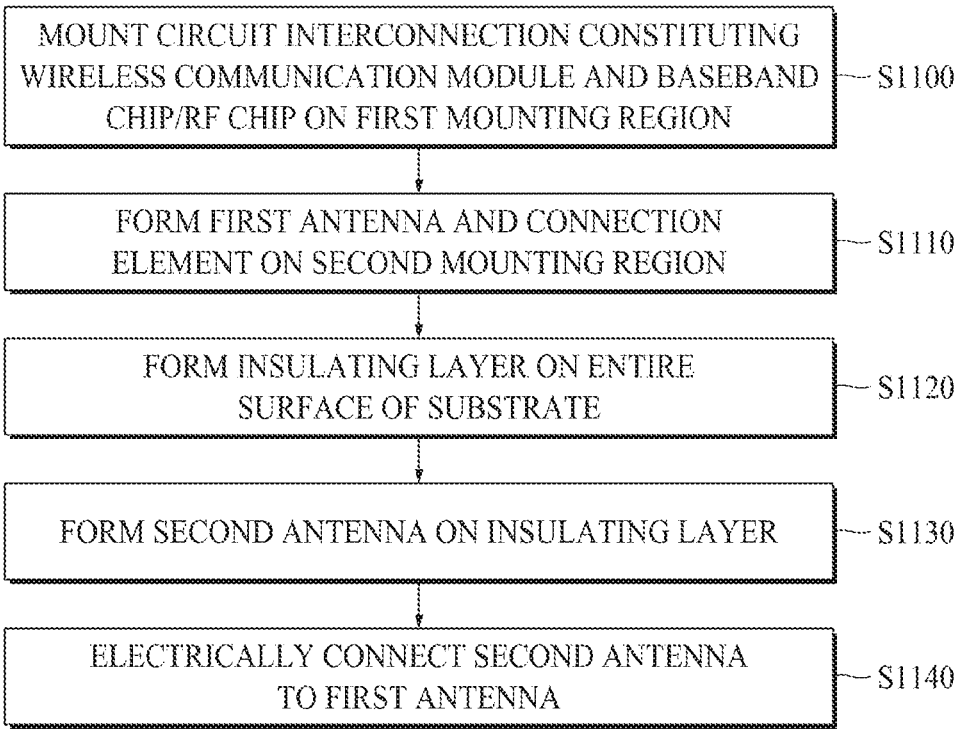
FIG. 11 is a flowchart of methods of fabricating the wireless communication chips according to the first and second exemplary embodiments of the present invention.

FIG. 11 is a flowchart of methods of fabricating the wireless communication chips according to the above-described first and second exemplary embodiments.

As shown in FIG. 11, to begin with, a circuit interconnection constituting a wireless communication module 220 and a baseband chip/RF chip 222, which is electrically connected to the circuit interconnection, may be mounted on a first mounting region 212 of a substrate 210 (S1100).

Thereafter, a first antenna 240 and a connection element 250 may be formed on a second mounting region 214 of the substrate 210 (S1110). As described above and shown in FIGS. 2A, 2B, and 3, the first antenna 240 includes a radiator pattern 310, a feeding pin 320, and a first ground unit 330. Further, the first antenna 240 may further include a second ground unit 340 configured to ground the connection element 250. Since the radiator pattern 310, the feeding pin 320, the first ground unit 330, and the second ground unit 340 have already been described with reference to FIGS. 2A, 2B, 3, and 6, a detailed description thereof will be omitted.

Meanwhile, the connection element 250 may be formed on the substrate 210 and protrude in a second direction D2 from another end 314 of the radiator pattern 310 included in the first antenna 240. In an exemplary embodiment, the connection element 250 may be implemented as a lumped element. According to the present embodiment, the first antenna 240 may be connected to a first terminal 252 of the connection element 250, and a second terminal 254 of the connection element 250 may be floated or grounded through the second ground unit 340.

Thereafter, insulating layers 224 and 260 may be formed on an entire surface of the substrate 210 (S1120). That is, the insulating layers 224 and 260 may be formed on the entire first and second mounting regions 212 and 214 of the substrate 210. The circuit interconnection constituting the wireless communication module 220, the baseband chip/RF chip 222, which is electrically connected to the circuit interconnection, the first antenna 240, and the connection element 250, may be wholly covered with the insulating layers 224 and 260.

In an exemplary embodiment, the insulating layers 224 and 260 may be formed by ejecting a material, such as epoxy or a ceramic material having a high dielectric constant, on the substrate 210 using a dispenser.

In the above-described embodiment, the insulating layers 224 and 260 have been described as being simultaneously formed on the first mounting region 212 and the second mounting region 214 of the substrate 210. However, in a modified exemplary embodiment, after the insulating layer 224 is formed by ejecting an insulating material on the first mounting region 212, the insulating layer 260 may be formed by ejecting an insulating material on the second mounting region 214.

In another exemplary embodiment, after the insulating layer 260 is formed by ejecting an insulating material on the second mounting region 214, the insulating layer 224 may be formed by ejecting an insulating material on the first mounting region 212.

In still another exemplary embodiment, after operation S1100 is ended, an insulating material may be ejected on the first mounting region 212 to form the insulating layer 224. Thereafter, operation S1110 may be performed to form the first antenna 240 and the connection element 250. Subsequently, an insulating material may be ejected on the second mounting region 214 to form the insulating layer 260.

In yet another exemplary embodiment, after operation S1110 is performed to form the first antenna 240 and the connection element 250, an insulating material may be ejected on the second mounting region 214 to form the insulating layer 260. Thereafter, operation S1100 may be performed to mount the circuit interconnection constituting the wireless communication module 220 and the baseband chip/RF chip 222 that is electrically connected to the circuit interconnection. Subsequently, an insulating material may be ejected on the first mounting region 212 to form the insulating layer 224.

Thereafter, a second antenna 270 may be formed on the insulating layer 260 (S1130). In an exemplary embodiment, the second antenna 270 may be formed on the insulating layer 260 and extend in a first direction D1. In this case, a first surface of the second antenna 270 may be in contact with the insulating layer 260, and a second surface of the second antenna 270, which is a reverse surface of the first surface, may be exposed outside a wireless communication chip 200. That is, in the present invention, the second antenna 270 of an antenna block 230 may be disposed in an outermost region of the antenna block 230 and exposed to the outside.

Subsequently, the second antenna 270 may be electrically connected to the first antenna 240 (S1140). In this case, a distance between the second antenna 270 and the substrate 210 may range from 0.2λ to 0.3λ.

In an exemplary embodiment, when a height of the connection element 250 is smaller than that of the insulating layer 260, a compression groove 272 may be formed by compressing a portion of the second antenna 270 so that the second antenna 270 may be connected to the connection element 250 by passing through the insulating layer 260. According to the present embodiment, the compression groove 272 of the second antenna 270 may be connected to a top surface of the first terminal 252 of the connection element 250.

As described above, the second antenna 270 may be electrically connected to the first antenna 240 so that a length of the first antenna 240 may be extended by as much as a length of the second antenna 270. In the above-described embodiment, since the connection element 250 is formed to have a smaller height than that of the insulating layer 260, the compression groove 272 may be formed in the second antenna 270 so that the second antenna 270 may be connected to the connection element 250. However, in another exemplary embodiment, the connection element 250 may have the same height as or a greater height than that of the insulating layer 260. Thus, when the top surface of the first terminal 252 of the connection element 250 is exposed to the outside, the second antenna 270 may be directly connected to the top surface of the first terminal 252 of the connection element 250 without the separate compression groove 272.

Hereinafter, a method of fabricating an electronic device including a wireless communication chip according to a third exemplary embodiment of the present invention will be described with reference to FIG. 12. From the method of fabricating the electronic device, only a method of fabricating a wireless communication chip and a method of mounting the fabricated wireless communication chip on a motherboard will be described in detail with reference to FIG. 12.

Figure 12:
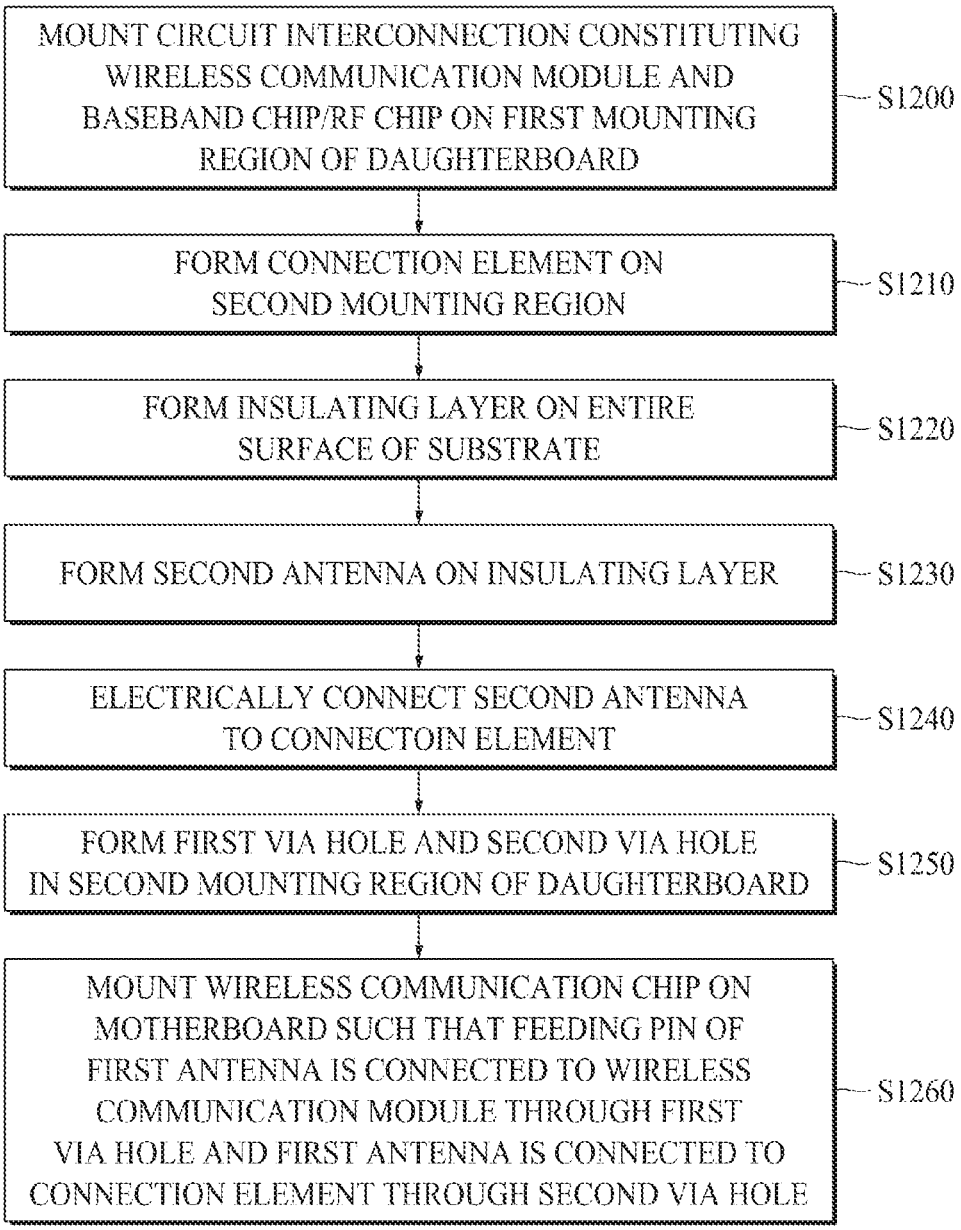
FIG. 12 is a flowchart of a method of fabricating the electronic device including the wireless communication chip according to the third exemplary embodiment of the present invention.

To begin with, as shown in FIG. 12, a circuit interconnection constituting a wireless communication module 220 and a baseband chip/RF chip 222, which is electrically connected to the circuit interconnection, may be mounted on a first mounting region 212 of a daughterboard 210 (S1200).

Next, a connection element 250 may be formed in a second mounting region 214 of the daughterboard 210 (S1210). The connection element 250 may be implemented as a lumped element. In an exemplary embodiment, a second terminal 254 of the connection element 250 may be electrically connected to a ground unit included in the wireless communication module 220 through a second ground unit 340.

Thereafter, insulating layers 224 and 260 may be formed on an entire surface of the daughterboard 210 (S1220). That is, the insulating layers 224 and 260 may be formed on the entire first and second mounting regions 212 and 214 of the daughterboard 210. The circuit interconnection constituting the wireless communication module 220, the baseband chip/RF chip 222, which is electrically connected to the circuit interconnection, and the connection element 250, may be wholly covered with the insulating layers 224 and 260.

In an exemplary embodiment, the insulating layers 224 and 260 may be formed by ejecting a material, such as epoxy or a ceramic material having a high dielectric constant, on the daughterboard 210 using a dispenser.

In the above-described embodiment, the insulating layers 224 and 260 have been described as being simultaneously formed on the first mounting region 212 and the second mounting region 214 of the daughterboard 210. However, in a modified exemplary embodiment, after the insulating layer 224 is formed by ejecting an insulating material on the first mounting region 212, the insulating layer 260 may be formed by ejecting an insulating material on the second mounting region 214.

In another exemplary embodiment, after the insulating layer 260 is formed by ejecting an insulating material on the second mounting region 214, the insulating layer 224 may be formed by ejecting an insulating material on the first mounting region 212.

In still another exemplary embodiment, after operation S1200 is ended, an insulating material may be ejected on the first mounting region 212 to form the insulating layer 224. Thereafter, operation S1210 may be performed to form the connection element 250. Subsequently, an insulating material may be ejected on the second mounting region 214 to form the insulating layer 260.

In yet another exemplary embodiment, after operation S1210 is performed to form the connection element 250, an insulating material may be ejected on the second mounting region 214 to form the insulating layer 260. Thereafter, operation S1200 may be performed to mount the circuit interconnection constituting the wireless communication module 220 and the baseband chip/RF chip 222 that is electrically connected to the circuit interconnection. Subsequently, an insulating material may be ejected on the first mounting region 212 to form the insulating layer 224.

Thereafter, a second antenna 270 may be formed on the insulating layer 260 (S1230). In an exemplary embodiment, the second antenna 270 may be formed on the insulating layer 260 and extend in a first direction D1. In this case, a first surface of the second antenna 270 may be in contact with the insulating layer 260, and a second surface of the second antenna 270, which is a reverse surface of the first surface, may be exposed outside a wireless communication chip 720. That is, in the present invention, the second antenna 270 of an antenna block 230 may be disposed in an outermost region of the antenna block 230 and exposed to the outside.

Thereafter, the second antenna 270 may be electrically connected to the connection element 250 (S1240). Thus, the wireless communication module 220 may be completed. In this case, a distance between the second antenna 270 and the daughterboard 210 may range from 0.02λ to 0.03λ.

In an exemplary embodiment, when a height of the connection element 250 is smaller than that of the insulating layer 260, a compression groove 272 may be formed by compressing a portion of the second antenna 270 so that the antenna 270 may be connected to the connection element 250 by passing through the insulating layer 260. According to the present embodiment, the compression groove 272 of the second antenna 270 may be connected to a top surface of a first terminal 252 of the connection element 250.

In the above-described embodiment, since the connection element 250 is formed to have a smaller height than that of the insulating layer 260, the compression groove 272 may be formed in the second antenna 270 so that the second antenna 270 may be connected to the connection element 250. However, in another exemplary embodiment, the connection element 250 may have the same height as or a greater height than that of the insulating layer 260. Thus, when the top surface of the first terminal 252 of the connection element 250 is exposed to the outside, the second antenna 270 may be directly connected to the top surface of the first terminal 252 of the connection element 250 without the separate compression groove 272.

Thereafter, a first via hole 810 and a second via hole 820 may be formed in the second mounting region 214 of the daughterboard 210 (S1250). The first via hole 810 may be formed to electrically connect a first antenna 240 formed on a motherboard 710 with the wireless communication module 220, and the second via hole 820 may be formed to electrically connect the first antenna 240 with the connection element 250.

Subsequently, the wireless communication chip 720 may be mounted on the motherboard 710 to be electrically connected to the first antenna 240 formed on the motherboard 710 (S1260). As described above with reference to FIGS. 8, 9A and 9B, the first antenna 240 formed on the motherboard 710 may include a radiator pattern 310, a feeding pin 320, and a first ground unit 330. Since the radiator pattern 310, the feeding pin 320, and the first ground unit 330 have been described above with reference to FIGS. 8, 9A and 9B, a detailed description thereof will be omitted.

In this case, when the wireless communication chip 720 is mounted on the motherboard 710, the first via hole 810 may be filled with a first conductor 812 to electrically connect the feeding pin 320 of the first antenna 240 with the wireless communication module 220. The second via hole 820 may be filled with a second conductor 822 to electrically connect the first antenna 240 with a lower end of the first terminal 252 of the connection element 250. As described above, since the first antenna 240 is electrically connected to the connection element 250 through the second via hole 820, and the connection element 250 is electrically connected to the second antenna 270, the first antenna 240 may be electrically connected to the second antenna 270 so that a length of the first antenna 240 may be extended by as much as a length of the second antenna 270.

Meanwhile, although not shown in FIG. 12, the above-described operations S1200 to S1260 may further include an operation of forming the first antenna 240 on the motherboard 710.

According to the present invention, since an antenna is embedded in a wireless communication chip, an RF cable configured to connect the antenna to the wireless communication chip is not required on a motherboard of an electronic device. Thus, manufacturing costs can be reduced, and the electronic device can be miniaturized.

In addition, according to the present invention, since an antenna is not directly designed on a motherboard of an electronic device, a resonance frequency of the antenna can be prevented from varying according to a shape or size of the motherboard.

Furthermore, according to the present invention, since a resonance frequency of an antenna is variable using a lumped element included in the antenna, the antenna can be applied to various applications without adding a separate component or changing components.

It will be understood by one of skill in the art that the present invention may be implemented in other specific forms without changing the technical spirit or essential characteristics thereof.

Therefore, it should be understood that the above-described embodiments are not restrictive but illustrative in every respect. The scope of the present invention is defined by the following claims rather than the detailed description. All changes or modifications that are derived from the meaning and scope of the claims and equivalents thereof should be construed as being included within the scope of the present invention.

| [Description of symbols] | |
|---|---|
| 200: wireless communication chip | 210: substrate |
| 220: wireless communication module | 230: antenna block |
| 240: first antenna | 250: connection element |
| 260: insulating layer | 270: second antenna |

What is claimed is:

1. A wireless communication chip having an internal antenna, the wireless communication chip comprising:

a substrate comprising a first mounting region and a second mounting region;

a wireless communication module molded on the first mounting region; and an antenna block mounted on the second mounting region to be electrically connected to the wireless communication module, wherein the antenna block comprises:

a first antenna on the substrate;

a connection element connected to the first antenna;

an insulating layer on the first antenna and the connection element to cover the first antenna and the connection element; and a second antenna on the insulating layer such that a first surface of the second antenna is in contact with the insulating layer and a second surface of the second antenna, which is a reverse surface of the first surface, is exposed to the outside of the wireless communication chip, wherein the second antenna is electrically connected to the first antenna through the connection element, wherein the first antenna comprises:

a radiator pattern;

a feeding pin configured to extend from one end of the radiator pattern in a second direction and supply a feeding signal supplied from the wireless communication module to the radiator pattern, the second direction being different from a first direction which is a lengthwise direction of the radiator pattern; and a first ground unit configured to ground the radiator pattern, wherein the first ground unit comprises:

a branch unit branched from the feeding pin in the first direction; and a ground pin configured to extend from one end of the branch unit in the second direction.

2. The wireless communication chip of claim 1, wherein the connection element is connected to another end of the radiator pattern, and wherein the first antenna further comprises a second ground unit configured to extend from the connection element in the second direction and ground the connection element.

3. The wireless communication chip of claim 1, wherein the radiator pattern is a meander line pattern.

4. The wireless communication chip of claim 1, wherein the connection element is a lumped element.

5. The wireless communication chip of claim 1, wherein the wireless communication module has the same height as that of the insulating layer.

6. The wireless communication chip of claim 1, wherein the connection element has a predetermined height from a surface of the substrate, and wherein the first antenna is electrically connected to a bottom surface of a first terminal of the connection element, and the second antenna is electrically connected to a top surface of the first terminal of the connection element.

7. The wireless communication chip of claim 6, wherein the second antenna comprises a compression groove configured to electrically connect the second antenna to the top surface of the first terminal of the connection element.

8. The wireless communication chip of claim 1, wherein a distance between the feeding pin and the ground pin ranges from 0.02λ, to 0.03λ.

9. An internal antenna for a wireless communication chip, the internal antenna comprising:

a first antenna on a substrate;

a connection element connected to the first antenna;

an insulating layer on the first antenna and the connection element to cover the first antenna and the connection element; and a second antenna on the insulating layer such that a first surface of the second antenna is in contact with the insulating layer, and a second surface of the second antenna, which is a reverse surface of the first surface, is exposed to the outside, wherein the second antenna is electrically connected to the first antenna through the connection element, wherein the first antenna comprises:

a radiator pattern;

a feeding pin configured to extend from one end of the radiator pattern in a second direction and supply a feeding signal supplied from a wireless communication module molded on the substrate to the radiator pattern, the second direction being different from a first direction which is a lengthwise direction of the radiator pattern; and a first ground unit configured to ground the radiator pattern, wherein the first ground unit comprises:

a branch unit branched from the feeding pin in the first direction; and a ground pin configured to extend from one end of the branch unit in the second direction.

10. The internal antenna of claim 9, wherein a distance between the feeding pin and the first ground unit ranges from 0.02λ, to 0.03λ.

11. The internal antenna of claim 9, wherein the connection element is connected to another end of the radiator pattern, and wherein the first antenna further comprises a second ground unit configured to extend from the connection element in the second direction and ground the connection element.

12. The internal antenna of claim 9, wherein the radiator pattern is a meander line pattern.

13. The internal antenna of claim 9, wherein the connection element is a lumped element.

14. The internal antenna of claim 9, wherein the connection element has a predetermined height from a surface of the substrate, and wherein the first antenna is electrically connected to a bottom surface of a first terminal of the connection element, and the second antenna is electrically connected to a top surface of the first terminal of the connection element.

15. The internal antenna of claim 9, wherein the second antenna comprises a compression groove configured to electrically connect the second antenna to a top surface of a first terminal of the connection element.

16. The internal antenna of claim 9, wherein a distance between the feeding pin and the ground pin ranges from 0.02λ, to 0.03λ.

* * * * *